US006607027B2

(12) United States Patent
Bosch et al.

(10) Patent No.: US 6,607,027 B2
(45) Date of Patent: Aug. 19, 2003

(54) SPIRAL FIN/TUBE HEAT EXCHANGER

(75) Inventors: Daniel J. Bosch, Racine, WI (US); James T. Haasch, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/827,394

(22) Filed: Apr. 5, 2001

(65) Prior Publication Data

US 2002/0148600 A1 Oct. 17, 2002

(Under 37 CFR 1.47)

(51) Int. Cl.[7] ..... F28D 7/04
(52) U.S. Cl. ..... 165/163; 165/164
(58) Field of Search ..... 165/145, 164, 165/163

(56) References Cited

U.S. PATENT DOCUMENTS

| | | | | |
|---|---|---|---|---|
| 1,945,287 A | * | 1/1934 | Monroe | 165/119 |
| 3,705,618 A | * | 12/1972 | Jouet et al. | 165/166 |
| 3,972,370 A | * | 8/1976 | Malaval | 165/163 |
| 4,124,069 A | * | 11/1978 | Becker | 165/164 |
| 4,696,339 A | | 9/1987 | Schwarz | |
| 4,836,276 A | | 6/1989 | Yamanska et al. | |
| 5,242,015 A | | 9/1993 | Saperstein et al. | |
| 5,339,640 A | | 8/1994 | Reinke | |

FOREIGN PATENT DOCUMENTS

| | | | | |
|---|---|---|---|---|
| DE | 1934193 | | 9/1978 | |
| DE | 690 00 712 T2 | | 7/1993 | |
| DE | 195 10 847 A1 | | 9/1996 | |
| DE | 198 08 893 A1 | | 9/1999 | |
| DE | 299 16 688 U1 | | 1/2000 | |
| DE | 199 13 459 C1 | | 8/2000 | |
| DE | 199 03 168 C2 | | 6/2002 | |
| EP | 1 114 975 A2 | | 7/2001 | |
| JP | 09-72679 A | * | 3/1997 | F28D/7/16 |
| SE | 183405 | * | 11/1958 | 165/164 A |
| WO | WO 99/67584 | | 12/1999 | |

* cited by examiner

*Primary Examiner*—Allen Flanigan
(74) *Attorney, Agent, or Firm*—Wood, Phillips, Katz, Clark & Mortimer

(57) ABSTRACT

A heat exchanger (12, 12B, 12C, 12D) usable as an oil cooler is provided for exchanging heat between first and second fluids. The heat exchanger has an outer periphery (112, 156, 58', 366) spaced from a central axis (56). The heat exchange includes an inlet (42, 378) and an outlet (44, 380) for flow of the first fluid, a pair of juxtaposed tube segments (52, 54) coiled about the central axis (56) to form a plurality of alternating concentric coils (58), an inlet (46) for flow of the second fluid into heat exchanger (12A, 12B, 12C, 12D), an outlet (48) for flow of the second fluid from the heat exchanger (12A, 12B, 12C, 12D), and structure (50) for encapsulating the pair of tube segments (52, 54) to retain the second fluid within the heat exchanger (12A, 12B, 12C, 12D) as it flows from the inlet (46) to the outlet (48). The tube segment (52) has an end (64) connected to the inlet (42) to receive flow of the first fluid therefrom. The tube segment (54) has an end (66) connected to the outlet (44) to deliver flow of the first fluid thereto. The pair of tube segments (52, 54) are connected adjacent the central axis (56) to transfer flow of the fluid between the tube segments (52, 54). The inlet and outlet (42, 44) for the first fluid are located adjacent the outer periphery (112, 156, 58', 366).

9 Claims, 11 Drawing Sheets

Fig. 11
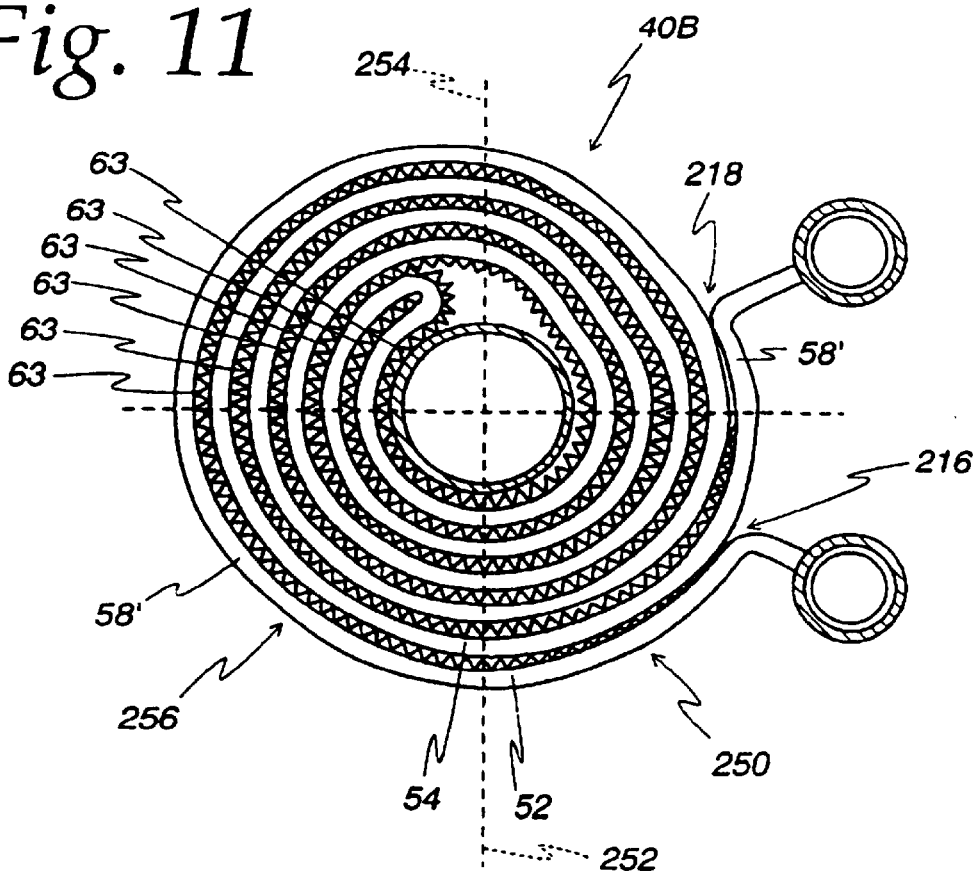
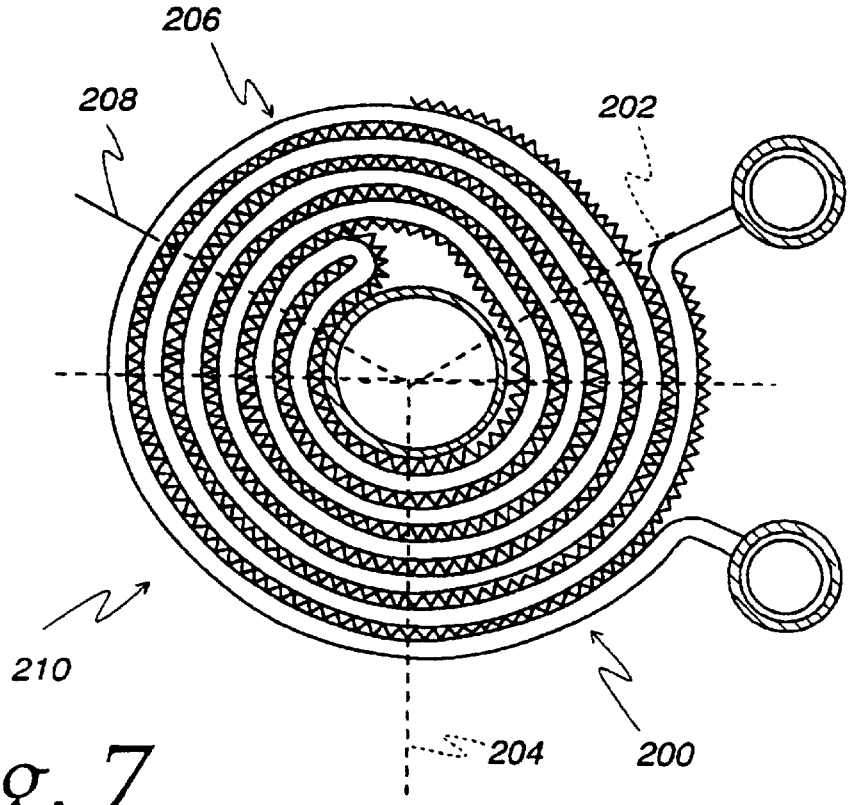
Fig. 7

SPIRAL FIN/TUBE HEAT EXCHANGER

FIELD OF THE INVENTION

This invention relates to heat exchangers, and more particularly, to heat exchangers used as oil coolers in vehicular applications.

BACKGROUND OF THE INVENTION

The use of heat exchangers to cool lubricating oil employed in the lubrication systems of internal combustion engines has long been known. One form of such heat exchanger currently in use is a so-called "donut" oil cooler. These oil coolers have an axial length of only a couple of inches or less and are constructed so that they may be interposed between the engine block and the oil filter, being attached directly to the block in a location formerly occupied by the oil filter. Typically, oil coolers of this type include a multi-piece housing which is connected to the vehicular cooling system to receive coolant, and which contains a stack of relatively thin, disk-like chambers or heat exchange units through which the oil to be cooled is circulated. Examples of such oil coolers are disclosed in U.S. Pat. Nos. 4,967,835; 4,561,494; 4,360,055; and 3,743,011, the entire disclosures of which are incorporated herein by reference.

The above heat exchangers have proven to be extremely successful, particularly in cooling the lubricating oil of an internal combustion engine. The structures of these heat exchangers are relatively simple in design, inexpensive to fabricate and readily serviceable when required. Nonetheless, there is a continuing desire to provide additional advantages in heat exchanger structures, including for example, improved heat transfer characteristics, improved pressure drop characteristics, reduced part count, increased structural integrity and cleanliness, and improved flexibility in the shape, size, and manufacturing processing of the heat exchanger.

SUMMARY OF THE INVENTION

It is the principal object of the invention to provide a new and improved heat exchanger, and more specifically, to provide an improved heat exchanger for use in oil cooler and vehicular applications. According to one aspect of the invention, a heat exchanger for exchanging heat between first and second fluids is provided. The heat exchanger has an outer periphery radially spaced from a central axis. The heat exchanger includes a first inlet for flow of the first fluid, a first outlet for flow of the first fluid, a pair of juxtaposed tube segments coiled about the central axis to form a plurality of alternating, concentric coils, a second inlet for flow of the second fluid into the heat exchanger, a second outlet for flow of the second fluid from the heat exchanger, and structure for encapsulating the pair of tube segments to retain the second fluid within the heat exchanger as it flows from the second inlet to the second outlet. The first inlet is located adjacent the outer periphery and the first outlet is located adjacent the outer periphery. One of the juxtaposed tube segments has an end connected to the first inlet to receive flow of the first fluids therefrom. The other of the juxtaposed tube segments has an end connected to the first outlet to deliver flow of the first fluid thereto. The pair of tube segments are connected adjacent the central axis to transfer flow of the first fluid between the tube segments.

According to one aspect of the invention, the pair of tube segments are formed from a unitary tube having a hairpin bend connecting the segments adjacent the central axis to transfer flow of the first fluid between the tube segments.

According to another aspect of the invention, the heat exchanger further includes a manifold connecting the tube segments adjacent the central axis to transfer flow of the first fluid between the tube segments.

According to one aspect of the invention, a heat exchanger is provided for exchanging heat between first and second fluids. The heat exchanger has an outer periphery radially spaced from a central axis. The heat exchanger includes a post substantially centered on the central axis and having an exterior surface with a spiral shaped transverse cross section, a tube segment wrapped about the exterior surface of the post to form spiral shaped tube coils about the central axis for directing the flow of the first fluid through the heat exchanger, an inlet for flow of the second fluid into the heat exchanger, an outlet for flow of the second fluid from the heat exchanger, and structure for encapsulating the tube segment to retain the second fluid within the heat exchanger as it flows from the second inlet to the second outlet.

According to one aspect of the invention, a heat exchanger is provided for exchanging heat between first and second fluids. The heat exchanger includes a pair of header plates for directing flow of the second fluid through the heat exchanger, and a core including a tube segment coiled about a central axis to form a plurality of concentric coils. The tube segment has at least one interior passage for flow of the first fluid. At least one of the coils defines an outermost periphery of the heat exchanger and has a first surface sealed against one of the header plates and a second surface sealed against the other of the header plates. At least one of the coils is sealed against at least one adjacent coil to retain the second fluid within the heat exchanger as it flows about the core.

According to one aspect of the invention, a heat exchanger is provided for exchanging heat between first and second fluids. The heat exchanger has an outer periphery spaced from a central axis. The heat exchanger includes a core surrounding the central axis, and a pair of opposed header plates. The core includes interior passages for receiving flow of the first fluid and exterior surfaces for receiving flow of the second fluid. The core has a pair of oppositely facing sides spaced by a width W along the central axis, with each side being open to the exterior surfaces. One of the header plates overlies one side of the core, and the other header plate overlies the other side of the core. One of the plates has first and second manifold chambers angularly spaced from each other about the central axis for directing flow of the second fluid over the exterior surfaces of the core.

According to one aspect of the invention, the other header plate has a third manifold chamber for directing flow of the second fluid over the exterior surfaces of the core. The first chamber is aligned with the third chamber to direct flow from the first chamber over a first angular segment of the exterior surfaces of the core to the third chamber. The third chamber is aligned with the second chamber to direct flow from the third chamber over a second angular segment of the exterior surfaces of the core to the second chamber. The first and second angular segments are angularly spaced from each other about the central axis.

According to another aspect of the invention, the other header plate includes third and fourth manifold chambers angularly spaced from each other about the central axis for directing flow of the second fluid over the exterior surfaces of the core. The first chamber is aligned with the third chamber to direct flow from the first chamber over a first angular segment of the exterior surfaces of the core to the third chamber. The third chamber is aligned with the second chamber to direct flow from the third chamber over a second angular segment of the exterior surfaces of the core to the second chamber. The second chamber is aligned with the fourth chamber to direct flow from the second chamber over a third angular segment of the exterior surfaces of the core to the fourth chamber. The first, second, and third angular segments are angularly spaced from each other about the central axis.

Other objects and advantages will become apparent from the following specification taken in connection with the accompanying drawings.

BRIEF DESCRIPTION OF THE DRAWINGS

FIG. 7 is a plan view of a core employed in the heat exchanger of FIG. 4 taken along line 7—7 in FIG. 4;

FIG. 11 is a plan view of a core employed in the heat exchanger of FIG. 8 taken along line 11—11 in FIG. 8;

DETAILED DESCRIPTION OF THE PREFERRED EMBODIMENT

Figure 1:
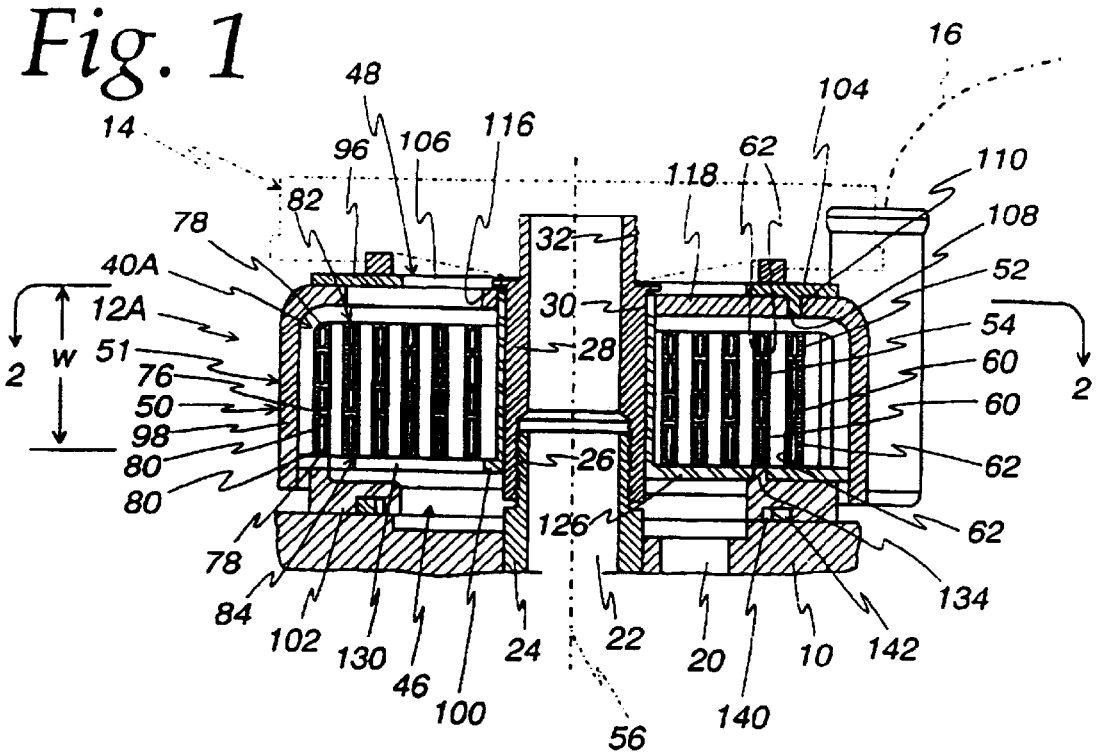
FIG. 1 is a fragmentary, sectional view of an engine block having mounted thereon a heat exchanger in the form of an oil cooler embodying the invention, with a portion of a filter of the customary type superimposed on the oil cooler and shown in dotted lines.

Several exemplary embodiments of heat exchangers made according to the invention are described herein and are illustrated in the drawings in connection with an oil cooler for cooling the lubricating oil of an internal combustion engine. However, it should be understood that the invention may find utility in other applications and that no limitation to use as an oil cooler is intended except insofar as expressly stated in the appended claims.

Figure 2:
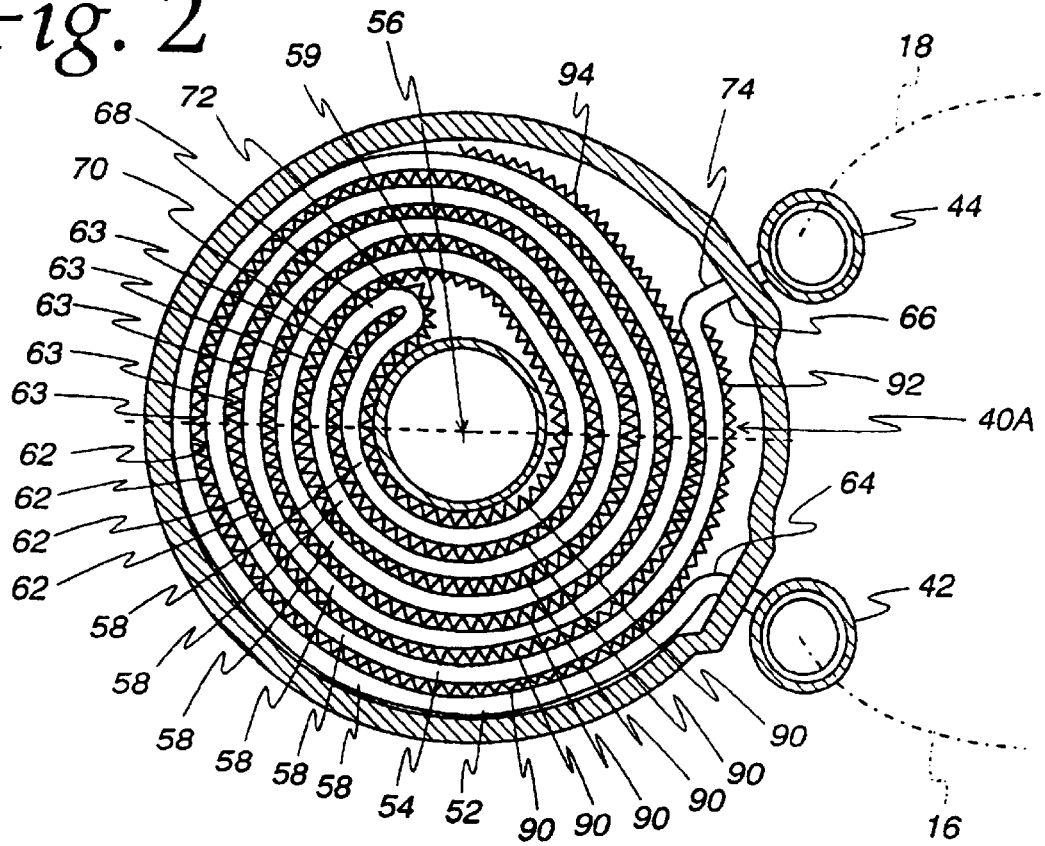
FIG. 2 is a section view taken along line 2—2 in FIG. 1.

With reference to FIG. 1, the block of an internal combustion engine is fragmentarily shown at 10 and has received thereon an oil cooler 12A for the lubricating oil for the engine. An oil filter 14 is secured to the oil cooler 12A and the latter additionally has coolant inlet and outlet lines 16 and 18 extending to the cooling system of the engine, as best seen in FIG. 2. As best seen in FIG. 1, lubricating oil is directed to the oil cooler 12 via a passage 20 in the block 10 and returning lubricating oil is received by the engine via a passage 22. The passage 22 is defined by a sleeve 24 fixedly attached to the engine block 10 and terminating in a threaded end 26 which in turn receives an internally threaded transfer tube 28 inserted through a central opening 30 in the oil cooler 12. The transfer tube 28 includes an externally threaded end 32 to which the oil filter 14 is removably connected in the conventional fashion.

As seen in FIGS. 1 and 2, the oil cooler 12A includes a fin/tube core 40A, a coolant inlet 42, a coolant outlet 44, an oil inlet 46, an oil outlet 48, and means 50, shown in the form of a multi-piece housing assembly 51, for encapsulating the core 40A to retain the oil within the oil cooler 12A as it flows from the oil inlet 46 to the oil outlet 48. As seen in FIG. 2, the core 40A includes a pair of juxtaposed tube segments 52 and 54 that are coiled about a central axis 56 to form a plurality of alternating concentric coils 58 with a hollow center 59. As seen in FIG. 1, the tube segments 52, 54 have plural interior passages 60 for receiving and directing flow of coolant through the oil cooler 12A, and exterior surfaces 62 for receiving and directing flow of the oil through the oil cooler 12A. The coils 58 are spaced from each other to define oil flow passages 63 between the exterior surfaces 62 of the tube segments 52, 54. As seen in FIG. 2, the tube segment 52 has an end 64 connected to the coolant inlet 42 to receive coolant therefrom, and the tube segment 54 has an end 66 connected to the coolant outlet 44 to deliver the coolant from its interior passages 60 to the coolant outlet 44. The ends 64, 66 are sealingly joined in respective mating slots (not shown) provided in the coolant inlet 42 and coolant outlet 44. The tube segments 52, 54 have respective ends 68, 70 that are connected adjacent the central axis 56 to transfer coolant from the interior passages 60 of the first tube segment 52 to the second tube segment 54. The ends 68, 70 are joined by a hairpin bend 72. Thus, the tube segments 52, 54 are actually part of a unitary hairpin tube 74 having ends 64, 66 spaced from the hairpin bend 72.

While tube segments 52, 54 may be of any known construction, it is preferred that the tube segments 52, 54 have a flat tube construction with multiple interior flow passages 60 defined by multiple webs 76 which are spaced between opposed end walls 78 of each of the tube segments 52, 54 and which join flat side walls 80 of each of the tube segments 52, 54, as seen in FIG. 1. It is also preferred that such flat tubes be formed of extruded aluminum, although so-called "fabricated tubes" may also be used, as is well known in the art. As seen in FIG. 1, it is also preferred that the walls 80 extend substantially parallel to the central axis 56. Further, it is preferred that the ends 78 define oppositely facing core sides 82 and 84 that extend substantially perpendicular to the central axis 56, and that are spaced by a width W along the central axis 56 that is nominally equal to the width of the major axis of the flat tube segments 52, 54.

The core 40A further includes heat exchange fins 90 which are provided in the oil flow passages 63 between the exterior surfaces 62 of the tube segments 52, 54. The fins 90 may be of any conventional form, including without limitation, louvered, ruffled, or slit serpentine fins; "skived" tube fins; expanded plate fins; and lanced and offset fins. Similarly, the fins may be formed of any suitable material having a good thermal conductivity, such as steel, copper, brass, or aluminum. It is preferred that the fins 90 be bonded or otherwise connected to the surfaces 62 to provide improved thermal conductivity. In the embodiment shown in FIG. 2, the fins 90 are shown in the form of aluminum serpentine fins 92, 94 wound in a spiral shape between the tube segments 52, 54.

Figure 3:
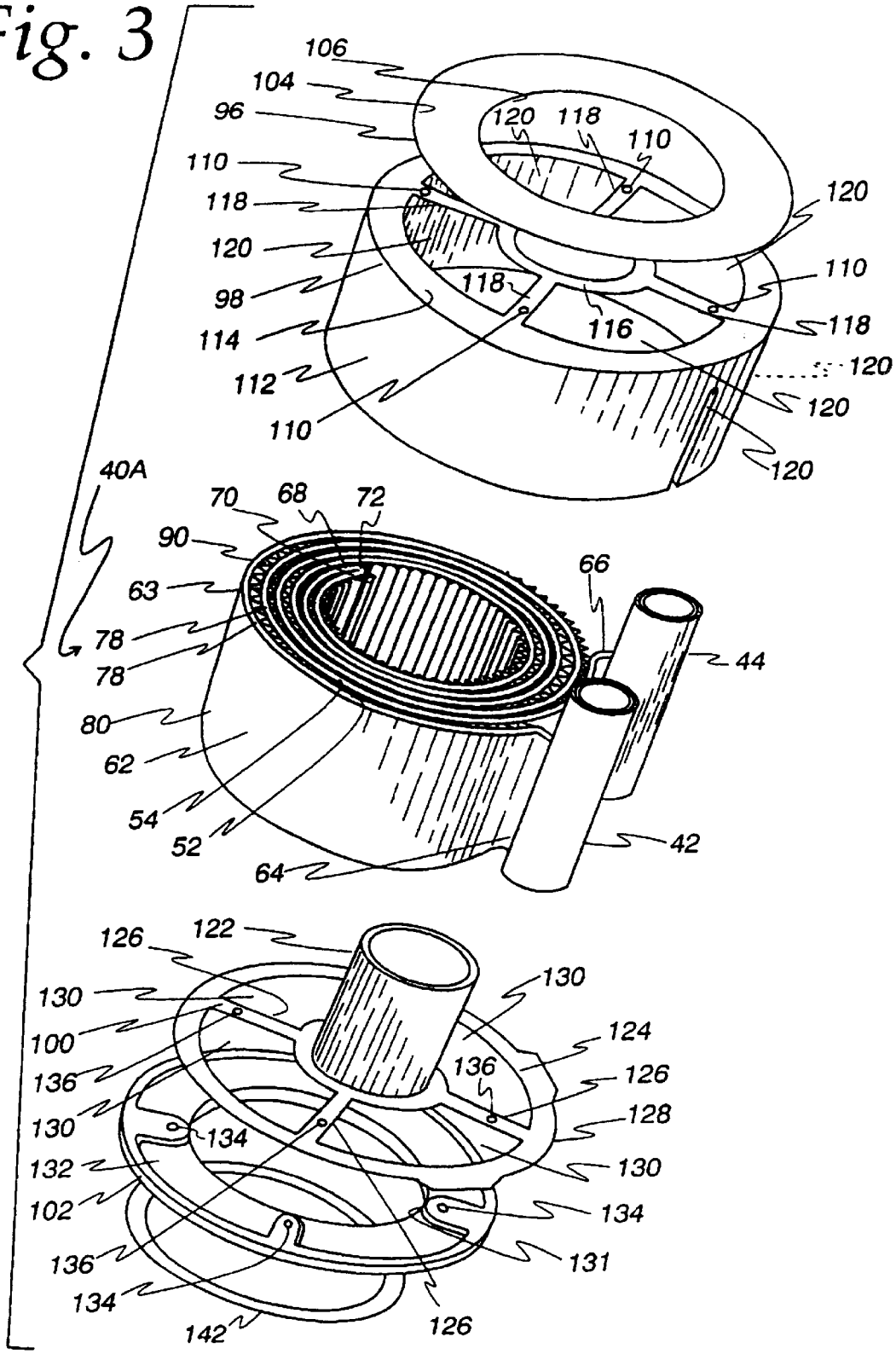
FIG. 3 is an exploded perspective view of the heat exchanger shown in FIG. 1.

As best seen in FIGS. 1 and 3, the multi-piece housing assembly 51 includes a filter plate 96, a tank 98, a combination header/post 100, and a gasket plate 102. The filter plate 96 is donut shaped and includes a nominally flat upper surface 104 for mating with the gasket of the filter 14, and a circular opening 106 that is centered on the axis 56 and directs oil to the oil outlet 48. The filter plate 96 further includes four locating tabs 108 (only one shown in FIG. 1) that are received in mating holes 110 in the tank 98 to positively locate the gasket plate 96 relative to the tank 98. The tank 98 has a circumferential wall 112 that is joined to a nominally flat end surface 114 to define a bowl shape for the tank 98. The tank 98 further includes a support ring 116 that is joined to the end surface 114 by four support arms 118. Together, the end surface 114, the ring 116, and the arms 118 define four openings 120 which provide for the flow of oil to the oil outlet 48. The wall 112 of the tank 98 further includes a pair of slots 120 (only one shown in FIG. 3), each of which nominally conforms to the exterior surface 62 of one of the ends 64, 66 of the tube segments 52, 54 to allow the tank 98 to be placed over the core 40A. The header/post 100 includes a cylindrical center post 122 which extends through the hollow center of the core 40A and defines the cylindrical opening 30 which receives the transfer tube 28. Preferably, the post 122 has an interference fit or is bonded to the innermost fins 90 at the center 59 of the core 40A. The header/post 100 further includes an outer ring 124 and four arms 126 (only three shown in FIG. 3) which extend between the post 122 and the outer ring 124 to support and locate the post 122 and the core 40 relative to the housing assembly 51. The ring 124 has an outer periphery 128 which conforms to and abuts the interior of the circumferential wall 112 and is tightly liquid sealed thereto. The post 122, arms 126, and outer ring 124 combine to define four openings 130 which provide a flow path to the oil inlet 46. The gasket plate 102 is donut shaped with a central opening 131. The gasket plate 102 includes a nominally flat surface 132 for mounting to the outer ring 124 and support beams 126 of the header/post 100. The gasket plate 102 further includes four locating tabs 134 (only one shown in FIG. 1) that are received in mating holes 136 (only three shown in FIG. 3) in the header/post 100 to positively locate the header/post 100 and the gasket plate 102 relative to each other. As best seen in FIG. 1, the gasket plate 102 further includes an annular groove or gasket gland 140 which receives a gasket 142 for sealing the oil cooler 12A to the engine block 10.

While the components of the housing assembly 51 may be formed of any suitable material and method, it is preferred that the filter plate 96, gasket plate 102, and header/post 100 be formed of impacted aluminum. Further, the interfaces between the core 40A, filter plate 96, tank 98, header/post 100, and gasket plate 102 may be bonded or joined by any suitable means to provide liquid tight seals of suitable structural integrity between the oil inlet 46 and oil outlet 48. Suitable joining methods include, without limitation, welding, vacuum brazing, or Nocolok™ flux brazing.

In operation, the oil flowing through the oil cooler 12A makes a single pass through the core 40A. More specifically, the oil enters the oil cooler 12A through the inlet 46 via the openings 131, 130 and then flows nominally parallel to the axis 56 through the passages 63 to exit from the oil cooler 12A through the outlet 48 via the openings 120 and 106. Coolant from the coolant inlet line 16 flows into the interior passages 60 of the tube segment 52 via the coolant inlet 42. The coolant then flows radially inwardly through the concentric coils 58 before transferring to the interior passages 60 of the tube segment 54 through the hairpin bend 72. The coolant flow transfers back to the coolant line 18 through the outlet 44 after flowing radially outwardly through the concentric coils 58 of the tube segment 54.

Figure 4:
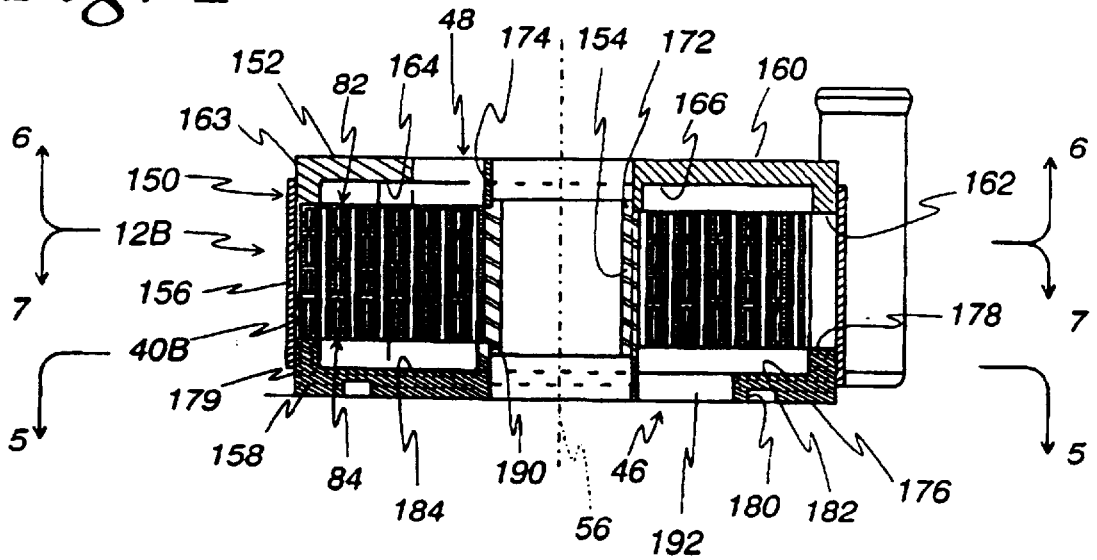
FIG. 4 is a sectional view of a heat exchanger made according to another embodiment of the present invention.
Figure 5:
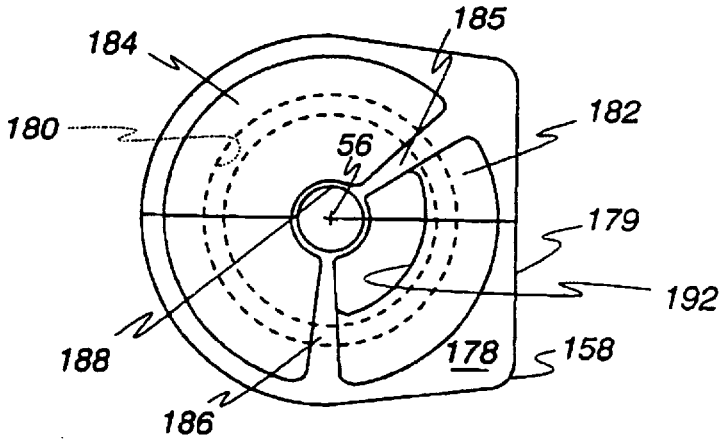
FIG. 5 is a plan view of a header employed in the heat exchanger of FIG. 4 taken along line 5—5 in FIG. 4.

An oil cooler 12B made according to another embodiment of the invention is shown in FIGS. 4–7. The oil cooler 12B utilizes the core 40A as described above for the oil cooler 12A, but has a means 50 for encapsulating the tube segments 52, 54 that is different than the multi-piece housing assembly 51 of the oil cooler 12A. More specifically, as seen in FIG. 4 the oil cooler 12B is provided with a means 50 in the form of a housing assembly 150 that includes a filter plate 152, a cylindrical center post 154, a circumferential side wall 156 and a header plate 158.

Figure 6:
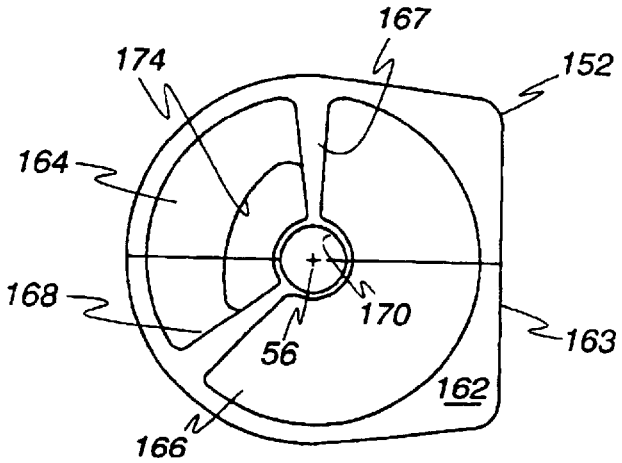
FIG. 6 is a plan view of another header employed in the heat exchanger of FIG. 4 taken along line 6—6 in FIG. 4.

As seen in FIG. 4, the filter plate 152 has oppositely facing, nominally flat surfaces 160 and 162 surrounded by a peripheral edge surface 163. The surface 160 is configured to mate with the sealing gasket of the filter 14. The surface 162 is configured to overlay and abut the side 82 of the core 40A. As seen in FIG. 6, the filter plate 152 further includes a pair of kidney-shaped manifold chambers 164 and 166 defined by reliefs formed into the surface 162 which are separated by walls 167 and 168. The filter plate 152 also includes a central opening 170 centered on the axis 56 and adapted to receive an annular shoulder 172 in the central post 154 to positively locate the central post 154 and the core 40A relative to filter plate 152. The filter plate 152 further includes a kidney-shaped opening 174 that extends from the manifold chamber 164 to the surface 160 to provide a flow path for the oil outlet 48.

As best seen in FIG. 4, the header plate 158 includes a pair of nominally flat, oppositely facing surfaces 176 and 178 surrounded by a peripheral edge surface 179. The surface 176 is configured to mate against the engine block 10 and includes an annular groove or gland 180 for receiving the gasket 142 to seal the oil cooler 12B to the engine block 10. The surface 178 is configured to overlay and abut the side 84 of the core 40A. The header plate 158 also includes a pair of kidney-shaped manifold chambers 182 and 184 defined by reliefs formed in the surface 178 which are separated by walls 185 and 186. The header plate 158 further includes a central opening 188 centered on the axis 56 and adapted to receive an annular shoulder 190 formed in the post 154 to positively locate the post 154, the core 40A, and the filter plate 152 relative to the header plate 158. A kidney-shaped opening 192 is provided in the header plate 158 extending between manifold chamber 182 and the surface 176 to provide a flow path to the oil inlet 46.

The wall 156 is formed from a strip of material that is wrapped around and bonded to the surfaces 163, 179 of the plates 152, 158 to provide a liquid tight seal. As with the circumferential wall 112 of the tank 98, the wall 156 includes openings or slots (not shown) that nominally conform to the exterior surfaces 62 of the ends 64, 66 of the tube segments 52, 54.

While it is preferred that each of the components of the housing assembly 150 be formed of aluminum, each of the components may be formed by any suitable material. Further, the interfaces between the core 40A, the filter plate 152, the center post 154, the circumferential side wall 156, and the header plate 158 may be bonded or joined by any suitable means to provide liquid tight seals of suitable structural integrity between the oil inlet 46 and the oil outlet 48. Appropriate joining methods include, without limitation, welding, vacuum brazing or Nocolok™ flux brazing.

In operation, the oil flowing through the oil cooler 12B makes three passes through the core 40A. More specifically, in the assembled state the manifold chambers 182, 166 are angularly aligned to direct flow from the chamber 182 over a first angular segment 200 of the core 40A to the chamber 166 for a first pass through the core 40A. The angular segment 200 is shown in FIG. 7 bounded by the dashed line 202 which corresponds to the wall 185 and the dashed line 204 which corresponds to the walls 186 and 167. The chamber 166 is angularly aligned with the chamber 184 to direct flow from the chamber 166 over a second angular segment 206 of the core 40A to the chamber 184 for a second pass through the core 40A. The angular segment 206 is shown in FIG. 7 bounded by dashed line 202 and dashed line 208 which corresponds to the wall 168. The chamber 184 is angularly aligned with the chamber 164 to direct oil flow from the chamber 184 over a third angular segment 210 of the core 40A to the chamber 164 so that the oil may exit the oil cooler 12B through the opening 174 after making its third pass through the core 40A. The angular segment 210 is shown in FIG. 7 bounded by line 204 and by line 208. Each of the angular segments 200, 206, 210 is nominally equal to one-third of the total volume of the core 40A. It should be understood that the walls 167, 168, 185, 186; the surfaces 162, 178; and the fins 90 cooperate to minimize or prevent oil flow from one of the angular segments 200, 206, 210 to another of the angular segments 200, 206, 210 as the oil flow passes through each angular segment 200, 206, 210.

An oil cooler 12C made according to the another embodiment of the invention is shown in FIGS. 8–11. The oil cooler 12C is for filter-less applications and uses a connector (not shown) with a head, a hollow interior up to the head, and radial holes to transfer oil between the oil cooler 12C and the hollow interior of the connector and the passage 22 of the engine block 10. The oil cooler 12C includes an encapsulating means 50 that differs from the multi-piece housing assembly 51 of the oil cooler 12A and the housing assembly 150 of the oil cooler 12B. More specifically, the encapsulating means 50 for the oil cooler 12C is provided in the form of a wear plate 212, the central post 154, a header plate 214, and portions of the outermost coils 58' of the tube segments 52, 54 of a core 40B that is identical to the core 40A except for the outermost coils 58' of the tube segments 52, 54 which are sealed against each other at locations 216, 218, as seen in FIG. 11, to retain the oil within the oil cooler 12B as it flows through the passages 63 of the core 40B.

Figure 8:
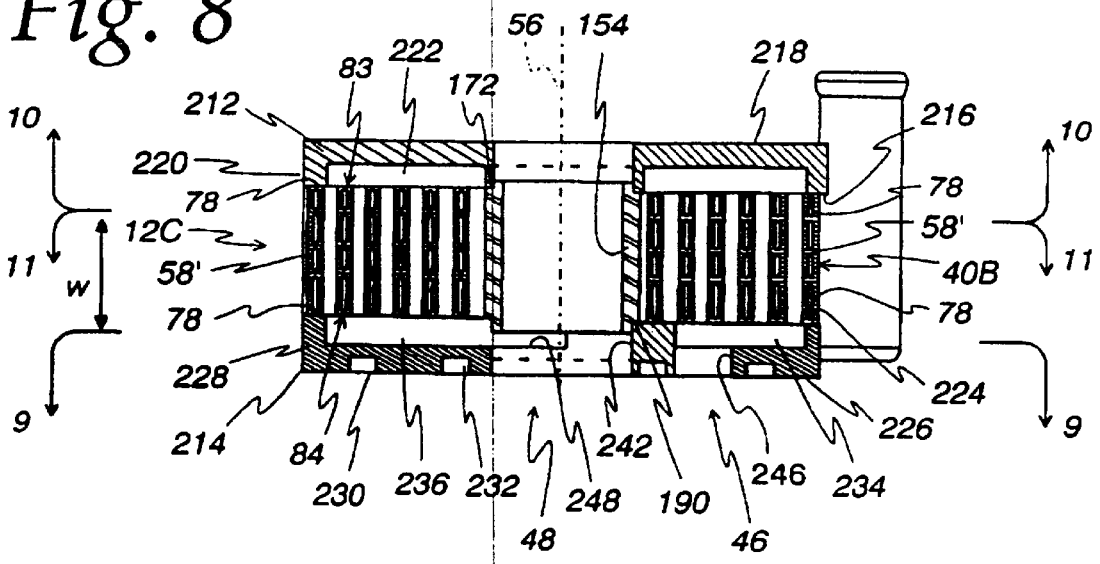
FIG. 8 is a sectional view of a heat exchanger made according to yet another embodiment of the present invention.
Figure 10:
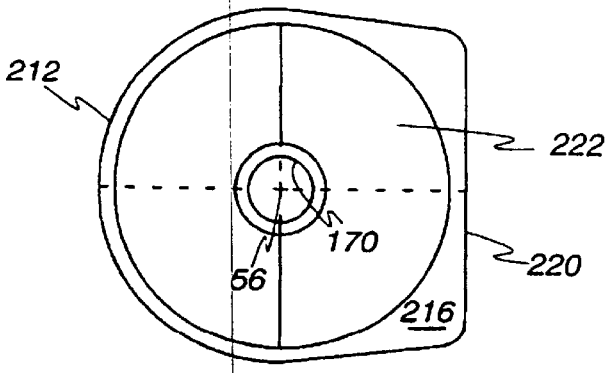
FIG. 10 is a plan view of another header employed in the heat exchanger of FIG. 8 taken along line 10—10 in FIG. 8.

As seen in FIG. 8, the wear plate 212 has oppositely facing, nominally flat surfaces 216 and 218 surrounded by a peripheral edge surface 220. The surface 216 is configured to overlay and abut the side 82 of the core 40B. As seen in FIG. 10, the wear plate 212 further includes a donut shaped manifold chamber 222 defined by a relief formed into the surface 216. As with the wear plate 152, the wear plate 212 includes a central opening 170 centered on the axis 56 and adapted to receive the angular shoulder 172 in the central post 154 to positively locate the central post 154 and the core 40B relative to the wear plate 212.

Figure 9:
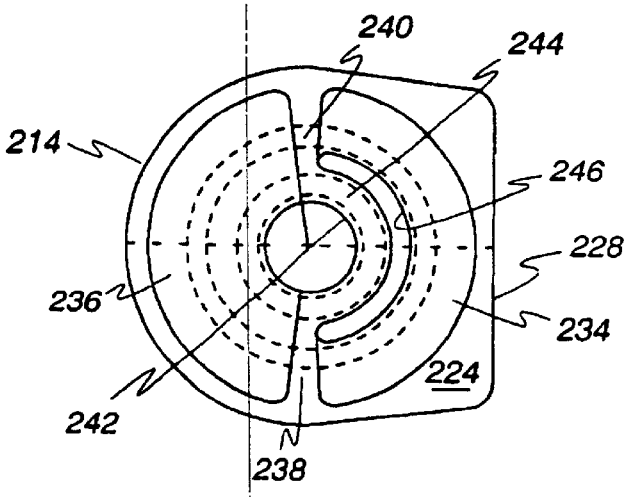
FIG. 9 is a plan view of a header employed in the heat exchanger of FIG. 8 taken along line 9—9 in FIG. 8.

As best seen in FIG. 8, the header plate 214 includes a pair of nominally flat, oppositely facing surfaces 224 and 226 surrounded by a peripheral edge surface 228. The surface 224 is configured to overlay and abut the side 84 of the core 40B. The surface 226 is configured to mate with engine block 10 and includes an annular groove or gland 230 for receiving the gasket 142 to seal the oil cooler 12C to the engine block 10. Additionally, the surface 226 includes another annular groove or gland 232 for receiving another gasket (not shown) to separate the hot incoming oil, which can collect between the glands 230 and 232, from the colder return oil, which can collect inside the space surrounded by the gland 232, thereby inhibiting or preventing oil by-pass. As best seen in FIG. 9, the header plate 214 is a surface that also includes a pair of kidney-shaped manifold chambers 234 and 236 defined by reliefs formed in the surface 224 which are separated by walls 238 and 240. The header plate 214 further includes a central opening 242 centered on the axis 56 and adapted to receive the annular shoulder 190 formed in the post 154 to positively locate the post 154, core 40B, and the wear plate 212 relative to the header plate 214. The opening 242 is closed from the manifold chamber 234 by an arcuate wall 244. A kidney-shaped opening 246 is provided in the header plate 214 extending between the manifold chamber 234 and the surface 226 to provide a flow path to the oil inlet 46. Additionally, the manifold chamber 236 is open to the central opening 242 to allow a flow path for the oil outlet 48. More specifically, as seen in FIG. 8, in the assembled state, the post 154 and the manifold chamber 236 cooperate to define an annular slot 248 to provide a flow path for the oil outlet 48. In this regard, it should be noted that the radial holes of the connector (not shown) allow oil to flow from the outlet 48 through the passage 22 to the engine block 10.

In the assembled state, the end walls 78 of the outermost coils 58', are sealingly bonded to the surfaces 216 and 224 of the plates 212 and 214, respectively, to retain the oil within the oil cooler 12C as it flows from the inlet 46 to the outlet 48 through the passages 63. Further, because the outermost coils 58' are sealingly bonded to each other along their entire width W at locations 216 and 218, the outermost coils 58' serve as an outer periphery of the oil cooler 12C, thereby making the oil cooler 12C a so-called "tankless" heat exchanger.

The plates 212, 214 may be formed of any suitable material, one preferred example of which is aluminum. Further, the interfaces between the core 40B, the filter plate 212, the center post 154, and the header plate 214 may be bonded or joined by any suitable means to provide liquid tight seals of suitable structural integrity between the oil inlet 46 and the oil outlet 48. Suitable joining methods include, without limitation, welding, vacuum brazing or Nocolok™ flux brazing.

In operation, the oil flowing through the oil cooler 12C makes two passes through the core 40B. More specifically, in the assembled state, the inlet manifold chamber 234 is aligned with the intermediate manifold chamber 222 to direct flow from the chamber 234 over a first angular segment 250 of the core 40B to the chamber 222 for a first pass through the core 40B. The angular segment 250 is shown in FIG. 11 bounded by line 252 which corresponds to the wall 238 and line 254 which corresponds to the wall 240.

The chamber 222 is angularly aligned with the chamber 236 to direct flow from the chamber 222 over a second angular segment 256 of the core 40B to the chamber 236 so that the oil may exit the oil cooler 12C through the openings 242, 248 after making a second pass through the core 40B. The angular segment 256 is shown in FIG. 11 bounded by lines 252 and 254. It can be seen from FIG. 11 that each of the angular segments is equal to approximately one-half of the total volume of the core 40B. It should be understood that the walls 238, 240; the surfaces 216, 224; and the fins 90 cooperate to minimize or prevent the flow of oil from each of the angular segments 250, 256 to the other of the angular segments 250, 256 as the oil flows through each of the angular segments 250, 256.

It also should be understood that the filter plate 152 and header plate 158 of the oil cooler 12B may also be utilized with the core 40B to form a tankless heat exchanger that provides three flow passes of the oil through the core 40B. Similarly, the filter plate 212 and header plate 214 may be utilized with the core 40A and the wall 156 of oil cooler 12B to form a two pass heat exchanger with the encapsulating means 50 of the oil cooler 12C.

Figure 12:
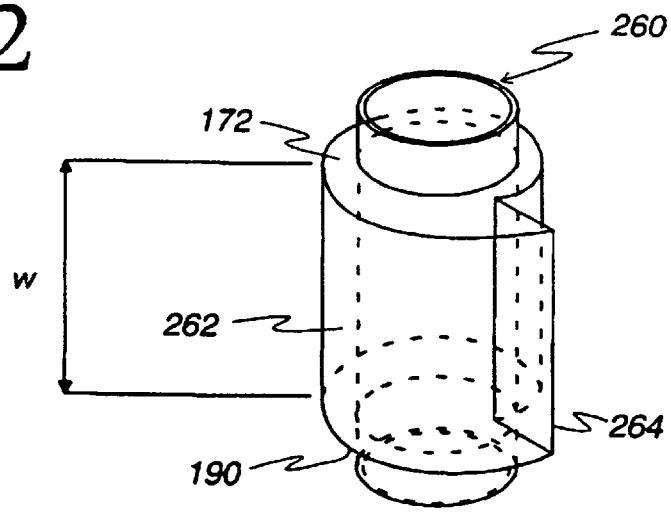
FIG. 12 is a perspective view of a post that may be employed in any of the heat exchangers embodying the present invention.
Figure 13:
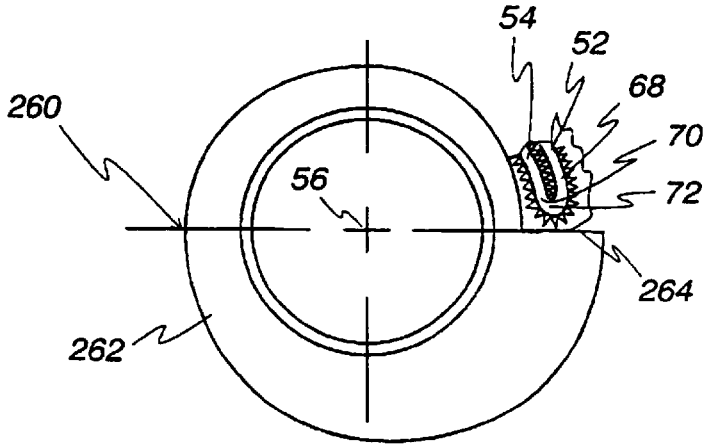
FIG. 13 is a fragmentary plan view of one embodiment of the post shown in FIG. 12 in combination with a portion of a heat exchanger core embodying the present invention.
Figure 14:
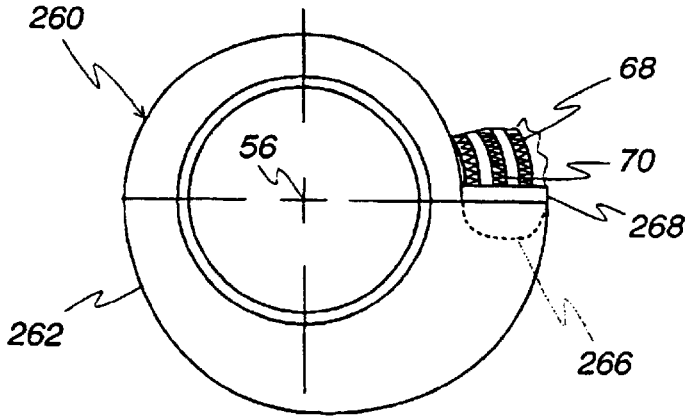
FIG. 14 is a fragmentary view of another embodiment of the post of FIG. 12 in combination with a portion of a heat exchanger core embodying the present invention.
Figure 15:
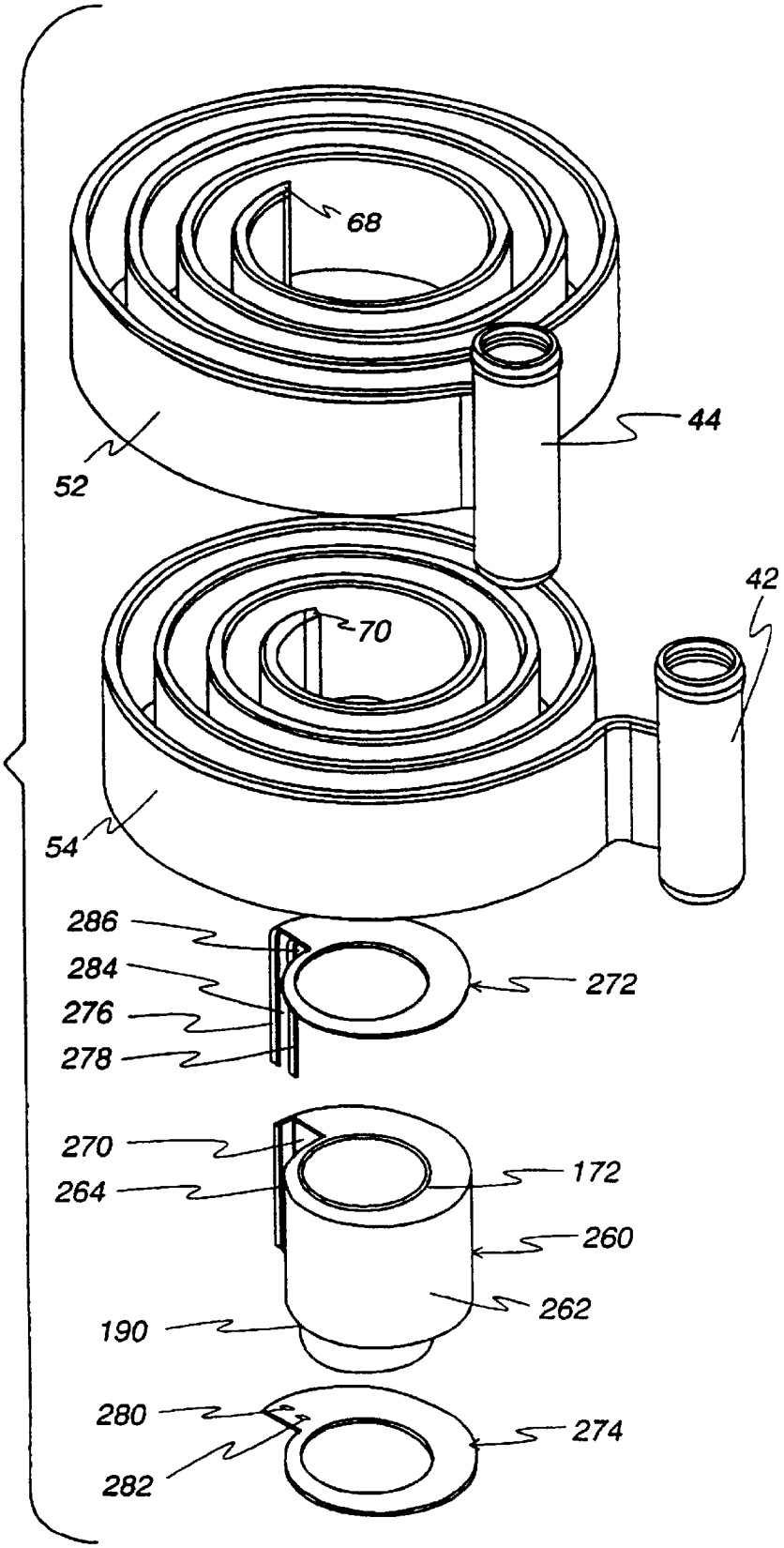
FIG. 15 is an exploded, perspective view showing an embodiment of the post of FIG. 12 with a portion of a heat exchanger core embodying the present invention;.

An alternate embodiment for the posts 122, 154 is shown in FIGS. 12–15 in the form of a post 260 that includes an exterior surface 262 with a spiral-shaped transverse cross-section about which the tube segments 52, 54 and fins 90 may be wrapped to form spiral-shaped tube coils 58 about the central axis 56. The spiral-shaped surface 262 extends parallel to the axis 56 over the width W. As best seen in FIGS. 12 and 13, in one embodiment of the post 260, an end wall 264 is provided for abutting the hairpin bend 72 that joins the tube segments 52, 54. The spiral post 260 restricts oil by-pass and the spiral shape aids in wrapping the tube segments 52, 54 and fins 90. As seen in FIG. 14, in another embodiment of the post 260, the end wall 264 is relieved to define a manifold chamber 266 that extends nominally parallel to the axis 56 and is closed by an end plate 268. The end plate 268 is provided with slots (not shown) that nominally conform and are sealed to the respective ends 68, 70 of the tube segments 52, 54 so that coolant flow may be transferred between the tube segments 52, 54 through the chamber 266. As seen in FIG. 15, in yet another embodiment of the post 260, a manifold channel 270 is formed in the end wall 264 extending nominally parallel to the axis 56 and enclosed by a first disk 272 and a second disk 274, both of which preferably have an outer periphery that nominally conforms to the spiral profile of the surface 262 and an inner periphery adapted to receive, respectively, the annular shoulders 172 and 190. The disk 272 includes a pair of beams 276 and 278 that extend nominally parallel to the length of the channel 270. The ends of the beams 276, 278 are received in apertures 280 and 282, respectively, in the disk 274 to define elongate slots 284 and 286 that nominally conform and are sealed to the respective ends 68, 70 of the tube segments 52, 54 so the coolant flow may be transferred between the tube segments 52, 54 through the manifold channel 270. It should be understood that each of the above described embodiments of the post 260 may be incorporated in any of the oil coolers 12A, 12B, and 12C and the cores 40A and 40B.

While the disclosed embodiments show fins 90 between the posts 122, 154, and 260 and the radially innermost coil 58, it may be advantageous in some applications to have no fins 90 between the radially innermost coil 58 and the posts 122, 154, and 260.

An oil cooler 12D made according to yet another embodiment of the invention as shown in FIGS. 16–21C. The oil cooler is a single pass unit similar to the oil cooler 12A, but includes a core 40C that differs in its details from the cores 40A and 40B, and an encapsulating means 50 that differ from the means 50 of the oil coolers 12A, 12B, and 12C.

Figure 16:
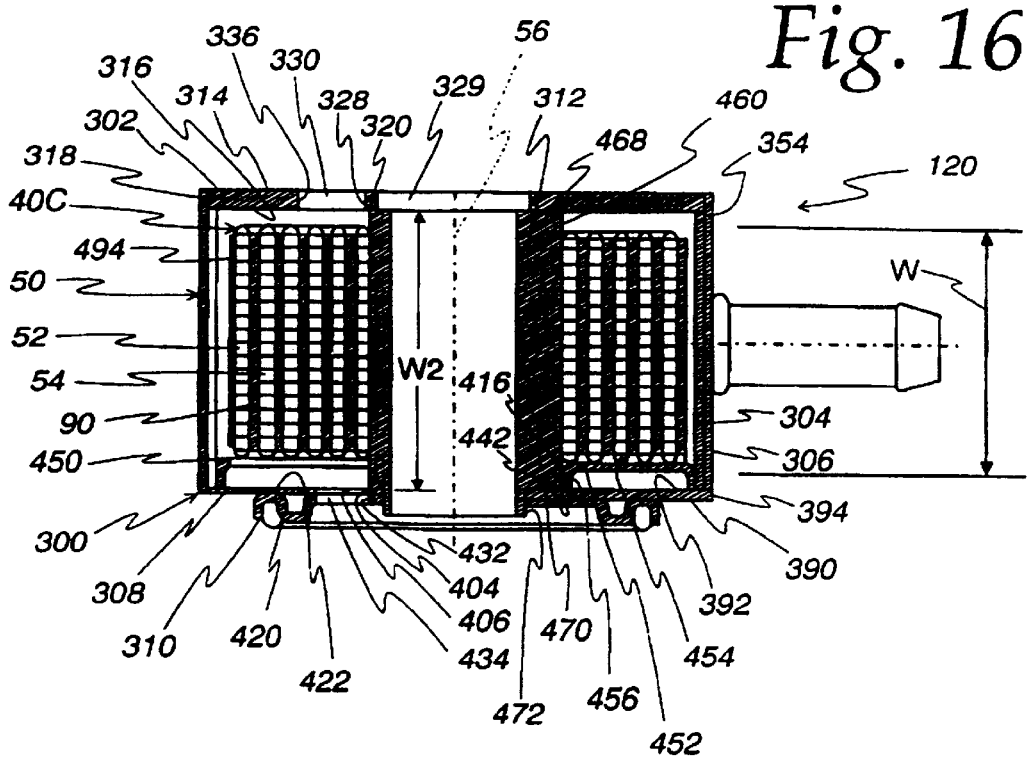
FIG. 16 is a sectional view of a heat exchanger made according to another embodiment of the present invention.
Figure 17:
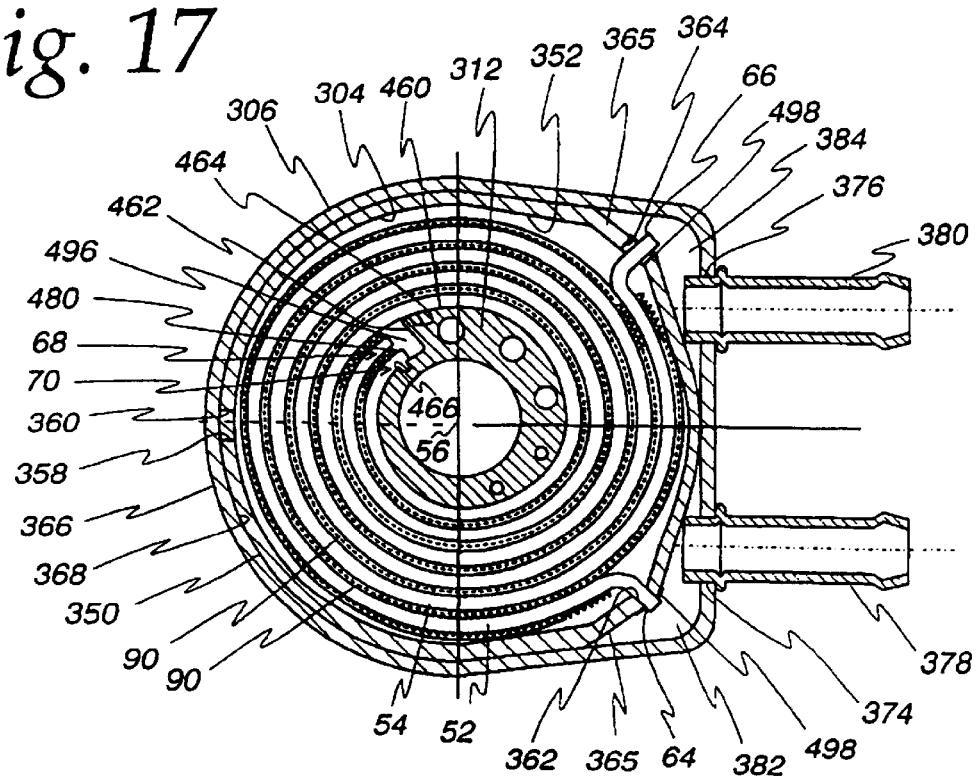
FIG. 17 is a sectional view taken along the line 17—17 in FIG. 16.

More specifically, as best seen in FIGS. 16 and 17, the oil cooler 12D is provided with a means 50 in the form of a housing assembly 300 that includes a filter plate 302; an internal, circumferential side wall 304; an external, circumferential side wall 306; a header plate 308; a gasket plate 310; and a spiral center post 312 that represents another embodiment of the center post 260 shown in FIGS. 12–15.

Figure 18:
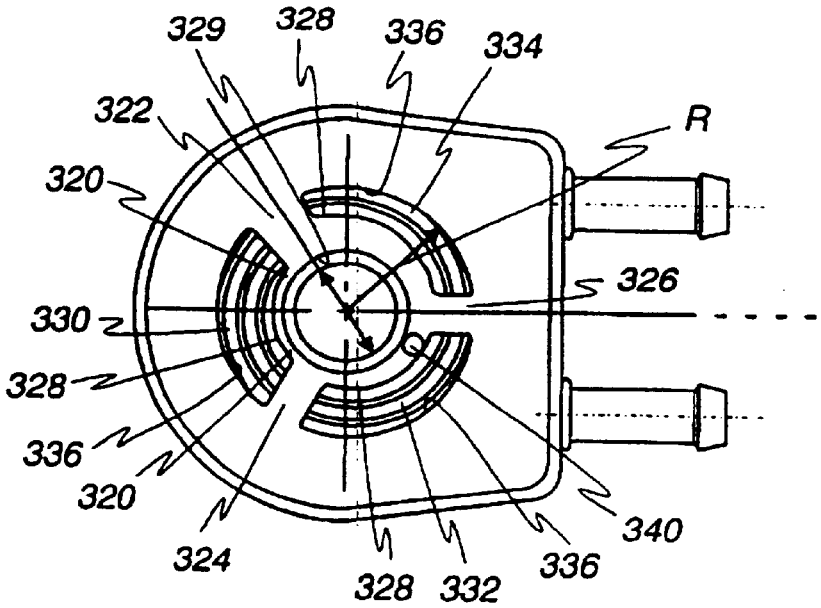
FIG. 18 is a plan view taken from line 18—18 in FIG. 16.
Figures 21A, 21B, 21C:
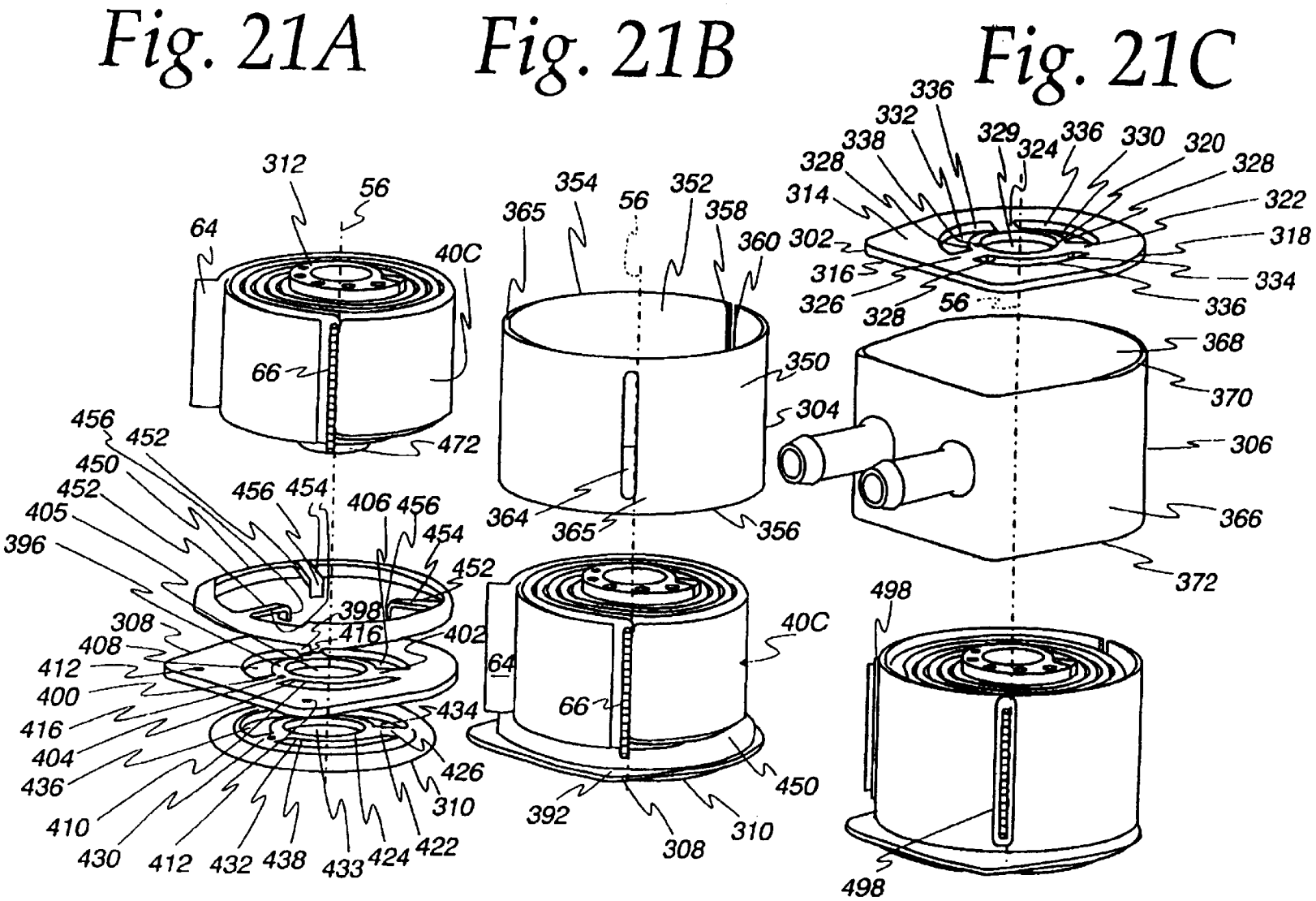
FIGS. 21A–21C are a series of exploded views illustrating a series of assembly steps for the heat exchanger shown in FIG. 16.

As best seen in FIGS. 18 and 21C, the filter plate 302 has oppositely facing, nominally flat surfaces 314 and 316 surrounded by a peripheral edge surface 318. The filter plate 302 is provided with a centrally located support ring 320 that is joined to the remainder of the filter plate by three support arms 322, 324, and 326. The support ring 320 includes a spiral shaped, outer peripheral edge surface 328 that extends between each of the legs 322, 324, and 326 and that nominally conforms to the spiral shape of the center post 312 so that the support ring 320 can be sealingly bonded to the center post 312 in the assembled state of the oil cooler 12D. The support ring 326 also includes a circular opening 329 that is centered on the axis 56. Three openings, 330, 332, and 334 which provide for the flow of oil to the oil outlet 48, are defined by the support ring 320, the arms 322, 324, and 326 and three radial edge surfaces 336 that are spaced from the axis 56 by a radius R. As best seen in FIG. 21C, a hole 338 is provided in the support ring 320 at a position overlying the center post 212 to receive a threaded fastener 340 (shown in FIG. 18) that extends through the filter plate 302 to engage the center post 312.

As best seen in FIGS. 17 and 21B, the inner, circumferential wall 304 includes a substantially cylindrical outer surface 350, a substantially cylindrical inner surface 352, an upper edge surface 354, a lower edge surface 356, a pair of facing end surfaces 358 and 360, and a pair of slots 362 and 364 (only one shown in FIG. 21B) that are configured to freely receive the ends 64, 66, respectively, of the tube segments 52 and 54. Preferably, a pair of planar segments 365 are provided in the wall 304, with the slots 362, 364 located in the planar segments as 365.

As best seen in FIGS. 17 and 21C, the exterior circumferential wall 306 includes a substantially cylindrical outer surface 366, and substantially cylindrical interior surface 368, an upper edge surface 370, a lower edge surface 372, and a pair of circular ports 374 and 376 that receive a coolant inlet fitting 378 and a coolant outlet fitting 380, respectively. Preferably, a planar segment 382 is provided in the wall 306, with the ports 374, 376 located in the planar segment 382. As best seen in FIGS. 16 and 21C, the interior surface 368 is shaped to conform to the edge surface 318 of the filter plate 302. Furthermore, as best seen in FIG. 17, the interior surface 368 is shaped to conform with selected portions of the exterior surface 350 of the interior wall 304 and, in combination with the exterior surface of 350 of the interior wall 304, to define an inlet manifold 382 and an outlet manifold 384 for the housing assembly 300.

Figure 19:
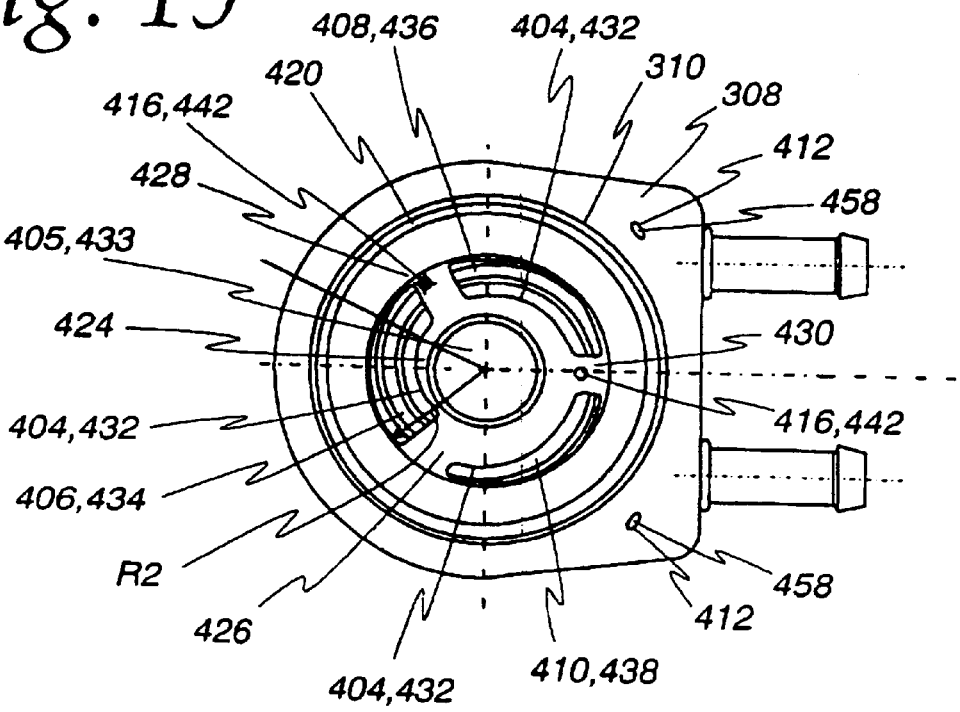
FIG. 19 is a plan view taken from line 19—19 in FIG. 16.

As best seen in FIGS. 16, 19 and 21A, the header plate 308 has oppositely facing, nominally flat surfaces 390 and 392 surrounded by a peripheral edge 394. The surface 392 is configured to be sealingly bonded with the edge surfaces 356 and 372 of the interior wall 304 and exterior wall 306, respectfully. The edge surface 394 is shaped to nominally conform to the shape of the exterior surface 366 of the exterior wall 306. As best seen in FIG. 21A, the header plate 308 is provided with a centrally located support ring 396 that is connected to the remainder of the header plate 308 by three arms 398, 400, and 402. The support ring has an outer peripheral edge surface 404 that extends between the arms 398, 400 and 402 and is shaped to nominally conform to the spiral shape of the center post 312. The support ring 396 also includes a circular opening 405 that is centered on the axis 56. Three openings 406, 408 and 410 provide for the flow of oil from the oil inlet 46 and are defined by the edge surface 404, the arms 398, 400, and 402, and the remainder of the header plate 308. The header plate 308 further includes a pair of tab receiving openings 412, the purpose of which will be more fully explained below. Additionally, the header plate 308 includes a pair of locating dimples 416 (only one shown in FIG. 16) that are engageable with the gasket plate 310 to locate the gasket plate 310 during assembly.

As best seen in FIGS. 16 and 21A, the gasket plate 310 is donut shaped and includes a annular groove or gasket gland 420 that receives the gasket 142 for sealing the oil cooler 12D to the engine block 10. The gasket plate 310 also includes an upper, nominally flat surface 422 that mates with the surface 390 of the header plate 308. Preferably, the gasket plate 310 further includes a centrally located support ring 424 that is connected to the remainder of the gasket plate 310 by three arms 426, 428, and 430. The support ring 424 includes an outer peripheral edge surfaces 432 that extends between the arms 426, 428 and 430 and is shaped to nominally conform to the edge surface 404 of the header plate 308 and the spiral shape of the center post 312. The support ring 424 also included a circular opening 433 that is centered on the axis 56. Three openings 434, 436, and 438 provide for the flow of oil from the oil inlet 46 and are defined by the edge surfaces 432, the arms 426, 428, and 430, and the remainder of the gasket plate 310. Preferably, the support ring 424, edge surface 432, arms 426, 428, 430 and openings 434, 436, 488 of the gasket plate 310 conform to the support ring 396, edge surface 404, arms 398, 400, 402 and openings 406, 408, 410, respectively, of the header plate 308. The gasket plate 310 also preferably includes a pair of openings 442 that receive the dimples 416 of the header plate 308 to locate the header plate 308 relative to the gasket plate 310 during assembly.

Preferably, as best seen in FIGS. 16 and 21A the oil cooler 12D further includes a spacer 450 that adds structural support to the tube segments 52, 54 and fins 90 of the core 40C and spaces the tube segments 52, 54 and Fins 90 from the header plate 308. As best seen in FIG. 21A, the spacer 450 is generally ring shaped and includes three arms 452 that overlay the arms 398, 400, and 402 of the header plate 308, with each of the arms 452 having a nominally flat upper surface 454 that mates with the bottom of the core 40C. Each of the arms 452 extend radially inward to a foot 456 that abuts the center post 312. In this regard, it should be noted that each of the arms 452 extends inward radially over a different length because of the spiral shape of the center post 312. The spacer 450 further includes a pair of tabs 458 that mate with the tab receiving openings 412 in the header plate 308, to locate the spacer 450 relative to the header plate 308 during assembly.

Figure 20E:
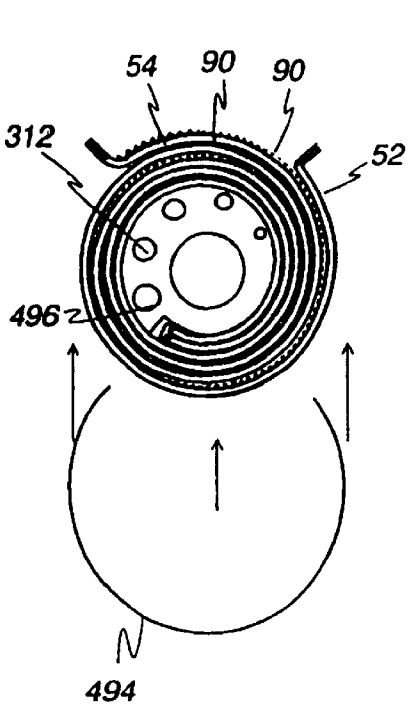
FIGS. 20A–20E are a series of perspective views illustrating an assembly procedure for a core of the heat exchanger shown in FIG. 16.
Figure 20D:
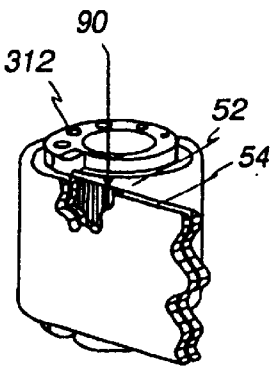
Figure 20C:
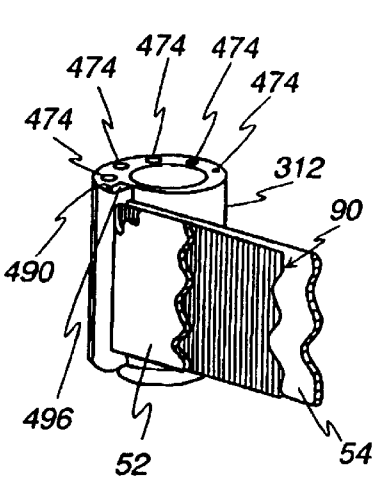
Figure 20B:
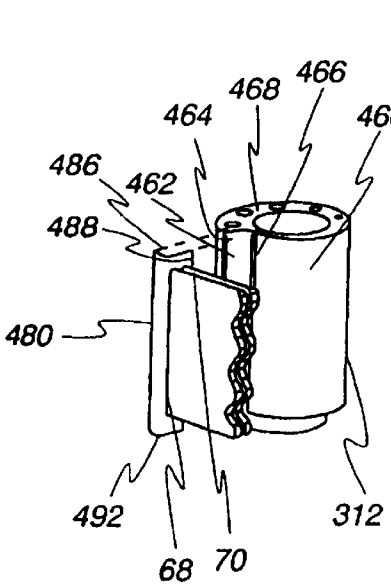

As best seen in FIGS. 16, 17, and 20B, the center post 312 includes an exterior surface 460 with a spiral-shaped transverse cross section about which the tube segments 52, 54 and fins 90 are wrapped to form the spiral-shaped tube coils about the central axis 56. The spiral-shaped surface 460 extends parallel to the axis 56 over a width W2 that is preferably greater than the major diameter of the tube segments 52 and 54. The post 312 further includes an end-wall 462 that extends parallel to the axis 56 over the entire width W2 of the surface 460. As best seen in FIGS. 17 and 20B, a pair of slots 464, 466 are provided in the exterior surface 460 extending parallel to the axis 56 over the entire width W2 of the surface 460 adjacent opposite sides of the end-wall 462. The purpose of the slots 464, 466 will be explained in more detail below in connection with the construction of the core 40C. The center post 312 also includes a nominally flat upper surface 468 that mates with the surface 316 of the filter plate 302, a nominally flat lower surface 470 that mates with the surface 392 of the header plate 308, and a nominally cylindrical surface 472 that extends from the surface 470 to be received and sealingly bonded in the openings 405, 433 of the support rings 396, 424 of the header plate 308 and the gasket plate 310, respectively. Optionally, as best seen in FIG. 20C, a series of lightening holes 474 may be provided in the center post 312 extending parallel to the axis 56 with the locations of the holes and size being such that they do not overlap with the the opening 329 in the filter plate 302 or the openings 405, 433 in the header plate 308 and gasket plate 310. One of the holes 474 is preferably positioned to underlie the hole 338 in the filter plate 302 and is tapped to threadably engage the fastener 340.

As best seen in FIGS. 17 and 20A–E, the core 40C includes a manifold plate 480 having a nominally J-shaped cross section transverse to the axis 56. The manifold plate 480 includes a pair of openings 482 and 484 that nominally conform to and are sealed with the respective ends 68, 70 of the tube segments 52, 54. The manifold plate 480 includes a pair of edge surfaces 486 and 488 that extend parallel to the axis 56 and are sealing bonded in the slots 464 and 466, respectively of the center post 312. The manifold plate 480 further includes an upper edge surface 490 and a lower edge surface 492. With the manifold plate 480 installed on the center post 312, the upper edge surface 490 is flush with the surface 468 of the center post 312, and the lower edge surface 492 is flush with the surface 470 of the center post 312, as best seen in FIG. 20C. Preferably, as best seen in FIGS. 16 and 20E, the core 40C also includes a spring band 494 that engages the outermost coils of the tube segments 52, 54 to retain the tube segments 52, 54 in their spiral coiled state about the center post 312 during assembly of the core 40C with the remainder of the oil cooler 12D.

Figure 20A:
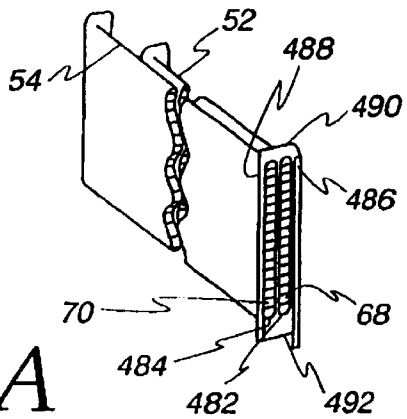

To assemble the core 40C, the tube ends 68, 70 are inserted into the respective openings 482, 484 of the manifold plate 480 and are secured to the plate 480 by staking each of the tube ends 68, 70 to the plate 480 at four locations, preferably by expanding four of the passageways in each of the tube ends 68 and 70, as best seen in FIG. 20A. The edges 486, 488 of the plate 480 are then inserted into the slots 464 and 466, respectively, of the center post 312 to create a manifold chamber 496, as best seen in FIGS. 20B and 20C. Next, one the fins 90 is assembled between the tubes 52, 54 and the tubes 52, 54, and fin 90 are then wrapped approximately 360° around the exterior surface 460 of the post 312. As best seen in FIG. 20D, a second fin strip 90 is then inserted between the coiled portion of the tube segment 52 and the straight segment of the tube 54 adjacent the manifold plate 480, and then the tube segments 52, 54 and fins 90 are wrapped around the center post 312 until the final spiral coiled shaped of the core 40C shown in FIG. 20E is achieved. The spring band 494 is then placed over the outer most coils of the tube segments 52, 54.

After the core 40C is assembled, the gasket plate 310, header plate 308, and spacer 450 are assembled together, with the dimple 416 received in the dimple receiving openings, 442, and the tabs 458 received in the tab receiving holes 412, as shown in FIGS. 21A and 21B. Next, the core 40C is assembled onto the spacer 450, with the cylindrical surface 472 extending through the openings 405, 433 in the support rings 396, 424, as seen in FIG. 21B. The interior wall 304 is then assembled over the core 40C by expanding the gap between the end surfaces 358, 360 until the wall 304 can be placed over the core 40C with the tube ends 64, 66 received in the openings 362, 364 and the lower edge surface seated against the surface 392 of the header plate 308. A pair of elongated grommet plates 498 are then assembled onto the tube ends 62, 64 and abutted against the flat segments 365 of the exterior surface 350 to be sealingly bonded thereto. Preferably, the grommets 498 are secured in placed by staking the tube ends 62, 64 in four places, such as by expanding four of the interior passageways of each of the tube ends 62, 54. Next, the exterior wall 306 is aligned with and slid over the interior wall 304 until the lower edge surface 372 is mated against the upper surface 392 of the header plate 308. The filter plate 302 is then aligned with the external wall 306 and assembled onto the remainder of the oil cooler 12D so that the edge surface 318 is mated with the interior surface 366 of the wall 306, and the bottom surface 316 is mated with the upper surface 468 of the center post 312 and the upper edge surface 354 of the wall 304, as best seen in FIG. 16. Next, the threaded fastener 340 is engaged into the receiving hole 474 of the center post 312 to retain the filter plate 302 during brazing. Finally, the oil cooler 12D is brazed using any suitable brazing process so that all of the mating surfaces are structurally bonded and liquid tightly sealed.

In operation, coolant is directed into oil cooler 12D via the inlet 378 into the manifold 382 where is then distributed into the interior passages of the tube end 64. The coolant then passes through the tube segment 52 to the manifold chamber 496 defined by the manifold plate 480, the center post 312, the lower surface 316 of the filter plate 302, and the upper surface 392 of the header plate 308. The coolant is then distributed to the interior passages of the tube segment 54 and is directed through the interior passages to the outlet manifold 384 so that the coolant can exit the oil cooler 12D through the outlet 380. The oil enters through the inlet 46 and is directed through the fins 90 by the openings 406, 408, 410 and 434, 436, 438. After passing through the core 40C, the oil is directed to the outlet 48 by the openings 330, 332, 334 of the filter plate 302.

It should be appreciated that the coolant flow through the oil coolers 12A, 12B, 12C, 12D is evenly distributed and controlled by providing the tube segments 52, 54 for directing the coolant flow through the oil coolers 12A, 12B, 12C, 12D thereby enhancing heat exchange performance.

It should also be appreciated that the constructions of the cores 40A, 40B, 40C can provide an even distribution of oil flow through the cores 40A, 40B, 40C with minimal entrance and exit loss effects.

Further, it should be appreciated that the cores 40A, 40B 40C can provide a relatively large amount of oil side surface area by utilizing the fins 90 in the oil passages 63, thereby further enhancing heat exchange performance. In this regard, it should be appreciated that the use of serpentine fins, plate fins, lance and offset fins, or "skived" fins 90 in the cores 40A, 40B, 40C add little if any contamination to the core's oil side cleanliness.

Additionally, it should be appreciated that the oil coolers 12A, 12B, 12C, 12D are relatively robust with respect to withstanding oil pressure cyclic fatiguing and bursting in comparison to conventional oil coolers which employ a plurality of bonded two plate heat exchange units, each of which is subject to structural failure from oil pressure cyclic fatiguing and bursting.

It should also be appreciated that the oil coolers 12A, 12B, 12C, 12D provide shape flexibility because the cores 40A, 40B, 40C can be wound to provide a shape, such as a rectangular or square shape, that is adapted to the available space for the oil cooler.

It should also be appreciated that the oil coolers 12A, 12B, 12C, 12D have a reduced part count when compared to most conventional oil coolers, which typically have a minimum of 30 to 40 parts, including the components for each of the two plate heat exchange units. Specifically, if fins 90 are provided, the oil cooler 12A can be formed from just nine parts, the oil cooler 12B can be formed from just nine parts, the oil cooler 12C can be formed from just eight parts and the oil cooler 12D can be formed from just fifteen parts. In this regard, the oil coolers 12A, 12B, 12C, 12D can provide size flexibility because, unlike most conventional oil coolers, the oil coolers 12A, 12B, 12C, 12D do not require additional parts to increase the heat transfer performance of the oil coolers. Rather, the width W of the cores 40A, 40B, 40C is simply increased by increasing the width of the tubes, fins, and post.

It should further be appreciated that the multi-passing of the oil flow through the oil coolers 12B and 12C can enhance the heat transfer performance of the oil coolers 12B, 12C. In this regard, it should be understood that obvious modifications can be made to the plates 152, 158, 212, 214 of the oil coolers 12B, 12C to provide additional passes of the oil flow through the cores 40A, 40B beyond the two and three passes for the exemplary embodiments shown in FIGS. 4–11.

What is claimed is:

1. A heat exchanger for exchanging heat between first and second fluids, the heat exchanger having an outer periphery radially spaced from a central axis, the heat exchanger comprising:

a first inlet for flow of the first fluid, the first inlet located adjacent the outer periphery:

a first outlet for flow of the first fluid, the first outlet located adjacent the outer periphery:

a pair of juxtaposed tube segments coiled about the central axis to form a plurality of alternating concentric coils, one of the segments having an end connected to the first inlet to receive flow of the first fluid therefrom, the other of the segments having an end connected to the first outlet to deliver flow of the first fluid thereto, the tube segments further being connected adjacent the central axis to transfer flow of the first fluid between the tube segments:

a second inlet for flow of the second fluid into the heat exchanger;

a second outlet for flow of the second fluid from the heat exchanger;

means for encapsulating said pair of tube segments to retain the second fluid within the heat exchanger as it flows from the second inlet to the second outlet; and a manifold connecting the tubes segment adjacent to the central axis to transfer flow of the first fluid between the tube segments.

2. The heat exchanger of claim 1, wherein the tube segments have flattened cross sections with major axes extending parallel to the central axis.

3. The heat exchanger of claim 1 wherein the tube segments are spiraled about the central axis to define an outer periphery of the coiled tube segments that is approximately round.

4. The heat exchanger of claim 1 further comprising a serpentine fin located between the pair of juxtaposed tube segments.

5. The heat exchanger of claim 1 wherein said encapsulating means comprises a tank surrounding the tube segments.

6. The heat exchanger of claim 1 wherein at least one of the coils defines the outer periphery of the heat exchanger and said encapsulating means comprises said at least one of the coils.

7. A heat exchanger for exchanging heat between first and second fluids, the heat exchanger having an outer periphery radially spaced from a central axis, the heat exchanger comprising:

a first inlet for flow of the first fluid, the first inlet located adjacent the outer periphery:

a first outlet for flow of the first fluid, the first outlet located adjacent the outer periphery:

a pair of juxtaposed tube segments coiled about the central axis to form a plurality of alternating concentric coils, one of the segments having an end connected to the first inlet to receive flow of the first fluid therefrom, the other of the segments having an end connected to the first outlet to deliver flow of the first fluid thereto, the tube segments further being connected adjacent the central axis to transfer flow of the first fluid between the tube segments:

a second inlet for flow of the second fluid into the heat exchanger;

a second outlet for flow of the second fluid from the heat exchanger;

means for encapsulating said pair of tube segments to retain the second fluid within the heat exchanger as it flows from the second inlet to the second outlet; and a manifold connecting one of the ends of the tube segments to one of the first inlet and first outlet, the manifold located within said means for encapsulating.

8. A heat exchanger for exchanging heat between first and second fluids, the heat exchanger having an outer periphery radially spaced from a central axis, the heat exchanger comprising:

a post substantially centered on the central axis and having an exterior surface with a spiral shaped transverse cross section;

a pair of tube segments wrapped about the exterior surface of the post to form spiral shaped tube coils about the central axis for directing flow of the first fluid through the heat exchanger;

an inlet for flow of the second fluid into the heat exchanger;

an outlet for flow of the second fluid from the heat exchanger;

means for encapsulating the tube segments to retain the second fluid within the heat exchanger as it flows from the second inlet to the second outlet; and a manifold connecting the tube segments adjacent the central axis to transfer flow of the first fluid between the tube segments.

9. The heat exchanger of claim 8 wherein the tube has a flattened cross section with a major diameter extending parallel to the central axis.

* * * * *